United States Patent [19]

McDonald et al.

[11] Patent Number: 4,516,806

[45] Date of Patent: May 14, 1985

[54] PORTABLE INFANT CARRIER

[75] Inventors: Quentin H. McDonald, 95 Morris La., Scarsdale, N.Y. 10583; Anthony P. Montalbano, Glen Cove; Philip Sieczkowski, Woodside, both of N.Y.

[73] Assignee: Quentin H. McDonald, Scarsdale, N.Y.

[21] Appl. No.: 457,022

[22] Filed: Jan. 10, 1983

[51] Int. Cl.[3] ..... A47C 7/14; A47C 7/16

[52] U.S. Cl. ..... 297/457; 297/452; 297/454

[58] Field of Search ..... 297/441, 452, 454, 457; 5/120, 122; 160/327

[56] References Cited

U.S. PATENT DOCUMENTS

| | | | |
|---|---|---|---|
| 2,829,702 | 4/1958 | Keating | 297/457 X |
| 3,006,688 | 10/1961 | Ouellette | 297/457 |
| 3,061,374 | 10/1962 | Grosfillex | 297/457 X |
| 3,165,356 | 1/1965 | Geier et al. | 297/457 X |

*Primary Examiner*—William E. Lyddane
*Assistant Examiner*—Peter R. Brown
*Attorney, Agent, or Firm*—Kenyon & Kenyon

[57] ABSTRACT

The portable infant carrier is made with a mesh body of three-dimensional shape which is molded with the frame of the seat. The mesh body conforms to the shape of the individual infant and thus permits an infant to be carried in a supported, semi-fetal position. A handle is provided by which the carrier can be transported in a pendulum-like manner. The seat may also be pivoted into one of a plurality of reclining positions relative to the leg support.

8 Claims, 11 Drawing Figures

10
11
12
13
14
15
16
17
20
21
22
23
27
28
29
30
31
32
34
36
38
39
41
5
I

22
I
26
21
23
41
47
40
45
46
15
32
29
30
24
16
11
25

14
31
30
39
30
28
33
15
29
32
34
24
38
15
34
29
44
48
42
22
20
41
44
35
36
37
42
21
27
43
47
13
22
23
45
19
40
41
16
46
11
16
19
18
17

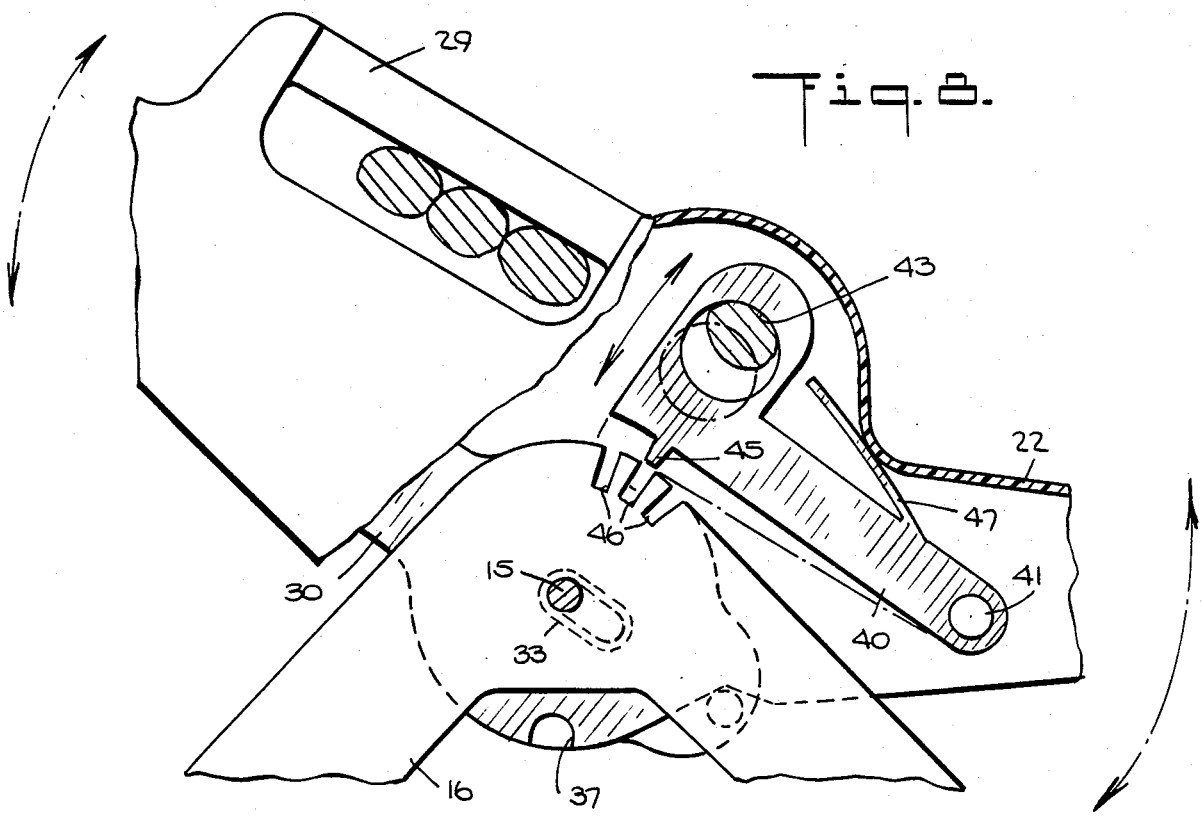
Fig. 8.
Fig. 9.
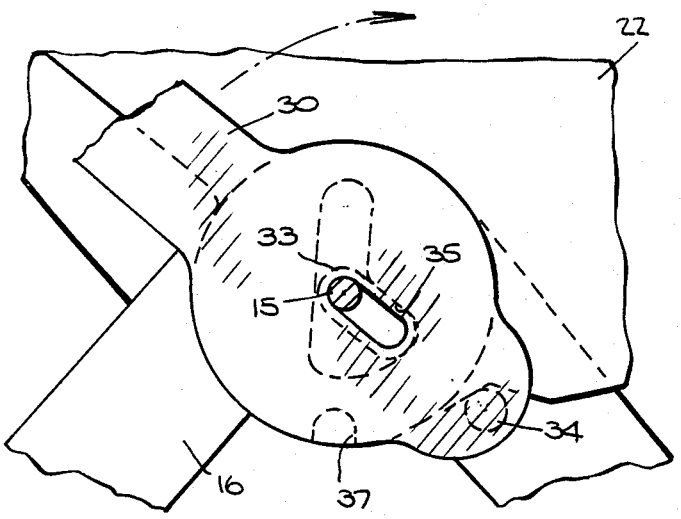
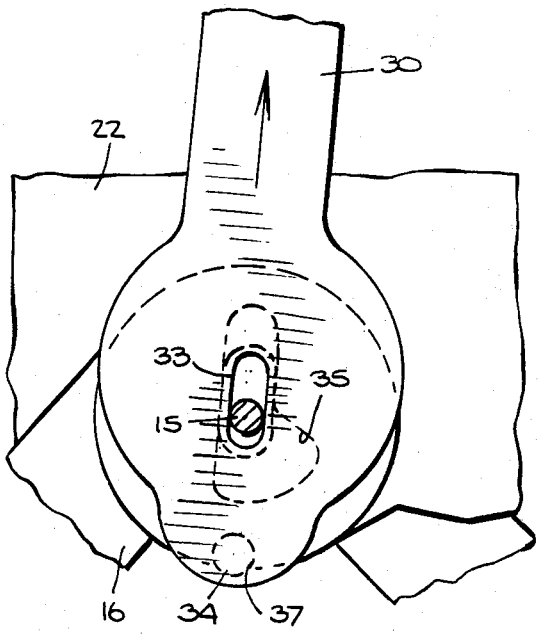
Fig. 10.

PORTABLE INFANT CARRIER

This invention relates to a portable infant carrier. More particularly, this invention relates to an infant carrier for transporting an infant in a cradled position.

Heretofore, various types of infant seats and carriers have been known, for example for transporting an infant from place to place or for positioning an infant for feeding purposes. In most cases, for example as described in U.S. Pat. Nos. 3,006,688; 3,101,972; and 3,334,944, the usual form for the seat carrier has been a flat back at a right angle to a flat shallow seat bottom with relatively shallow sides. In other cases, seats have been known which are provided with pads or the like to cushion an infant, such as described in U.S. Pat. No. 3,976,328, or which are constructed to maintain an infant in a slightly reclined sitting position, such as described in U.S. Pat. No. 3,596,986. However, such constructions are generally uncomfortable for new-born infants and for infants up to about four months of age, for they slip down in the seat or to the side of the hard, flat support back.

Further, in those cases where the infant carriers have been made of shell-like construction and which receive an infant directly against the shell or against a pad placed against the shell, if the infant remains within the carrier for a long period of time, particularly in hot weather, a lack of air circulation may cause the infant to perspire to an uncomfortable extent.

Still further, in order to provide an infant carrier which is thoroughly sturdy and yet adjustable to various reclining positions, relatively expensive mechanisms have been required. As a result, the expense of manufacturing the infant carriers has been relatively high.

Accordingly, it is an object of the invention to provide an infant carrier which is capable of carrying a new born infant in a cradled, semi-fetal position.

It is another object of the invention to provide a portable infant carrier for holding an infant in a supportive, comfortable position.

It is another object of the invention to provide an infant carrier that will adapt itself in size to the newborn infant as well as the four-month-old infant.

It is another object of the invention to provide an infant carrier which is light weight construction.

It is another object of the invention to provide an infant carrier which can be made in a relatively inexpensive manner.

Briefly, the invention provides a carrier for an infant which comprises a contoured skeletal frame and a mesh body secured to and across the frame for receiving an infant thereon in a cradled manner. In addition, where the frame and mesh body form a seat, the carrier includes a leg support on which the seat is adjustably mounted as well as a releasable lock means on each side of the frame for securing the seat to the leg support in a selected one of a plurality of positions. This permits the carrier seat to be tilted in different positions, e.g. to a position for sleeping, a position for feeding, and the like.

In accordance with the invention, the mesh body and the skeletal frame are integrally formed of a plastic material, such as polypropylene in order to facilitate fabrication at a limited cost. In addition, the mesh body has a molded three-dimensional shape which defines a recess for receiving an infant in a cradled manner.

The infant carrier is also provided with a carrying handle which is adjustably secured to the seat for movement between a raised position relative to the seat and a stored position. This handle permits the carrier to be transported in a pendulum-like manner.

The carrier seat also includes a pair of oppositely disposed integrally-formed handles on the skeletal frame which permit the carrier to be picked up and carried by a person using two hands. Further, the lock means may include a slidably mounted pawl adjacent a respective handle as well as a plurality of spaced slots in the leg support for selectively receiving the pawl therein in locking relation. Each pawl may also be provided with a finger-receiving aperture adjacent to a handle so that a person may simultaneously grasp the handles while releasing the pawls from the leg support. This movement permits the seat to be adjusted relative to the leg support.

These and other objects and advantages of the invention will become more apparent from the following detailed description taken in conjunction with the accompanying drawings wherein:

FIG. 8 illustrates an enlarged view of a lock means according to the invention;

FIG. 9 illustrates a fragmentary view of the carrying handle in a stored position; and FIG. 10 illustrates a fragmentary view of the carrying handle in a raised position.

Figures 1, 11:
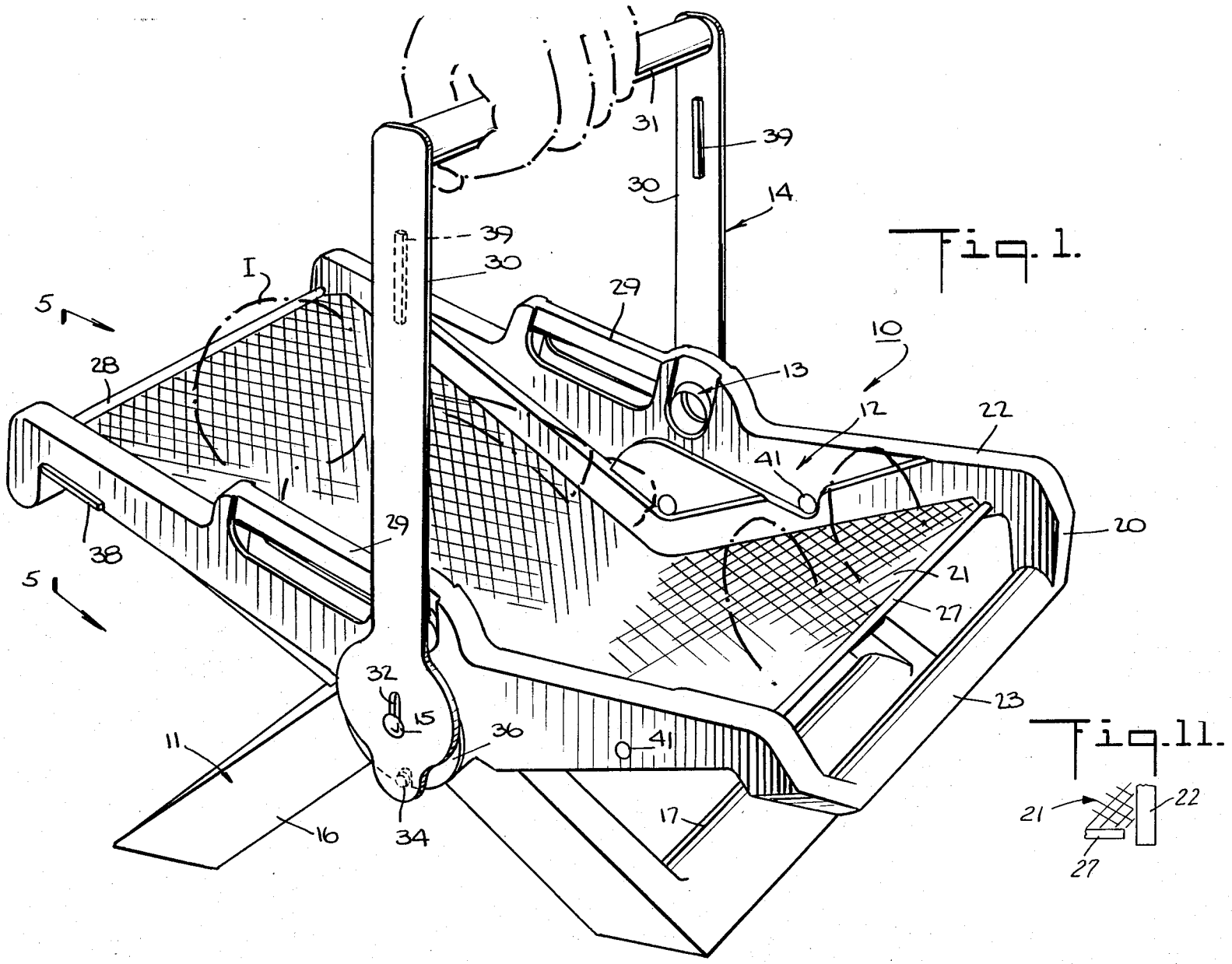
FIG. 1 illustrates a perspective view of an infant carrier in a transported condition in accordance with the invention.
FIG. 11 illustrates a detail view from FIG. 1.
Figure 7:
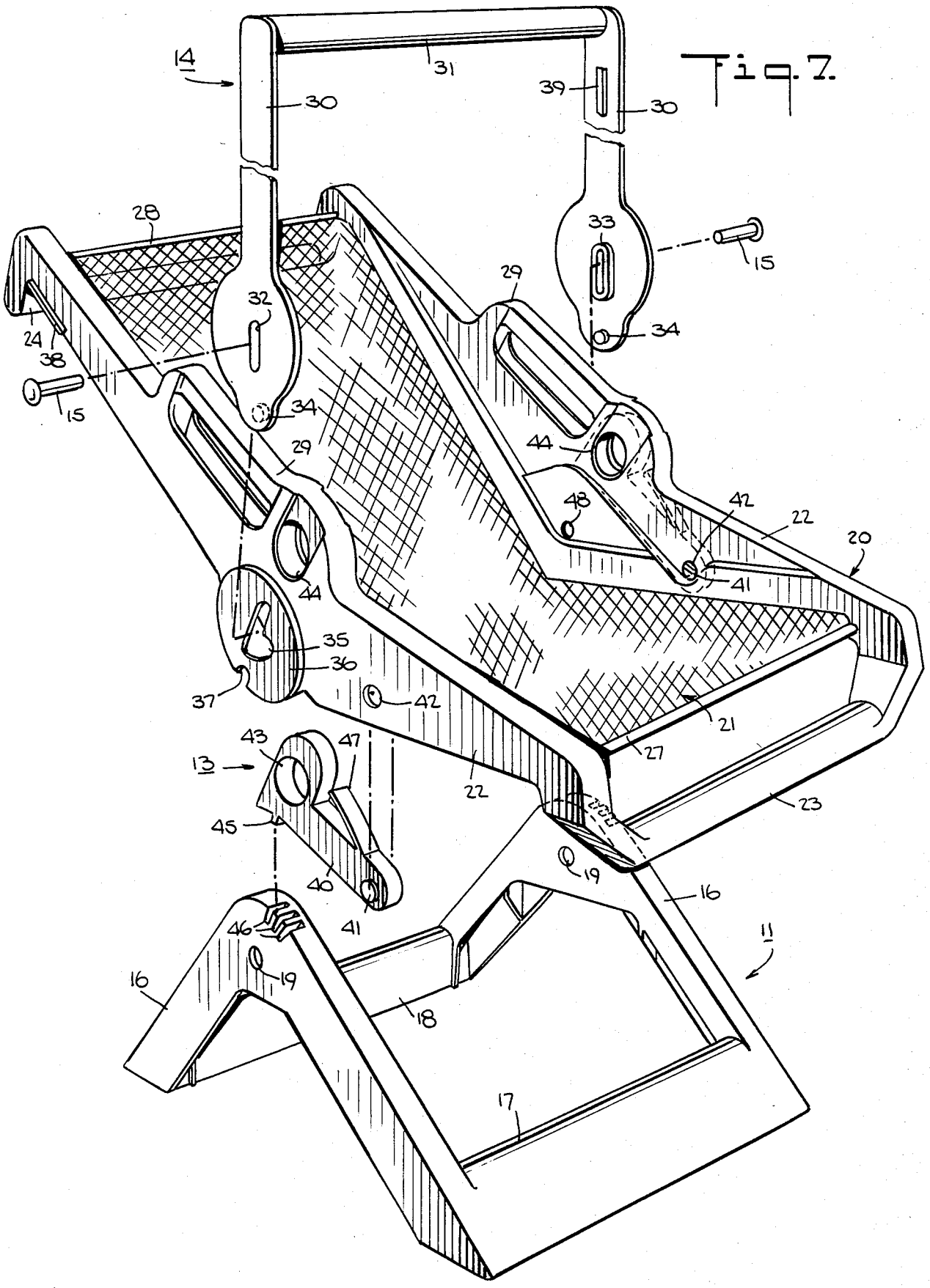
FIG. 7 illustrates an exploded view of the infant carrier of FIG. 1.

Referring to FIGS. 1 and 7, the portable infant carrier 10 includes a leg support 11, a seat 12 which is adjustably mounted on the leg support 11, lock means 13 for releasably securing the seat 12 relative to the support frame 11, a carrying handle 14 and rivets 15 for securing the leg support 11, seat 12 and handle 14 together.

Referring to FIG. 7, the leg support 11 is made of a one piece molded body, for example of polypropylene. As indicated, the leg support includes a pair of inverted V-shaped legs 16 which are interconnected by a front cross bar 17 and a rear cross bar 18. Each leg 16 is of generally channel shaped cross-section while the cross bars 17, 18 are of generally hollow construction. Each leg 16 also includes an aperture 19 near the apex for receiving a rivet 15.

Referring to FIG. 7, the seat 12 is formed of a rigid contoured skeletal frame 20 and a mesh body 21 which is secured to and across the frame 20 for receiving an infant I thereon in a cradled manner. The skeletal frame 20 includes a pair of parallel upstanding walls 22 of channel shape (see FIG. 5) a front cross-bar 23 and a rear cross-bar 24. Each of the cross-bars 23, 24 is integral with the walls 22 and may be made of hollow construction. As indicated in FIG. 7, the cross-bars 23, 24 are spaced below the mesh body 21.

Figures 4, 5, 6:
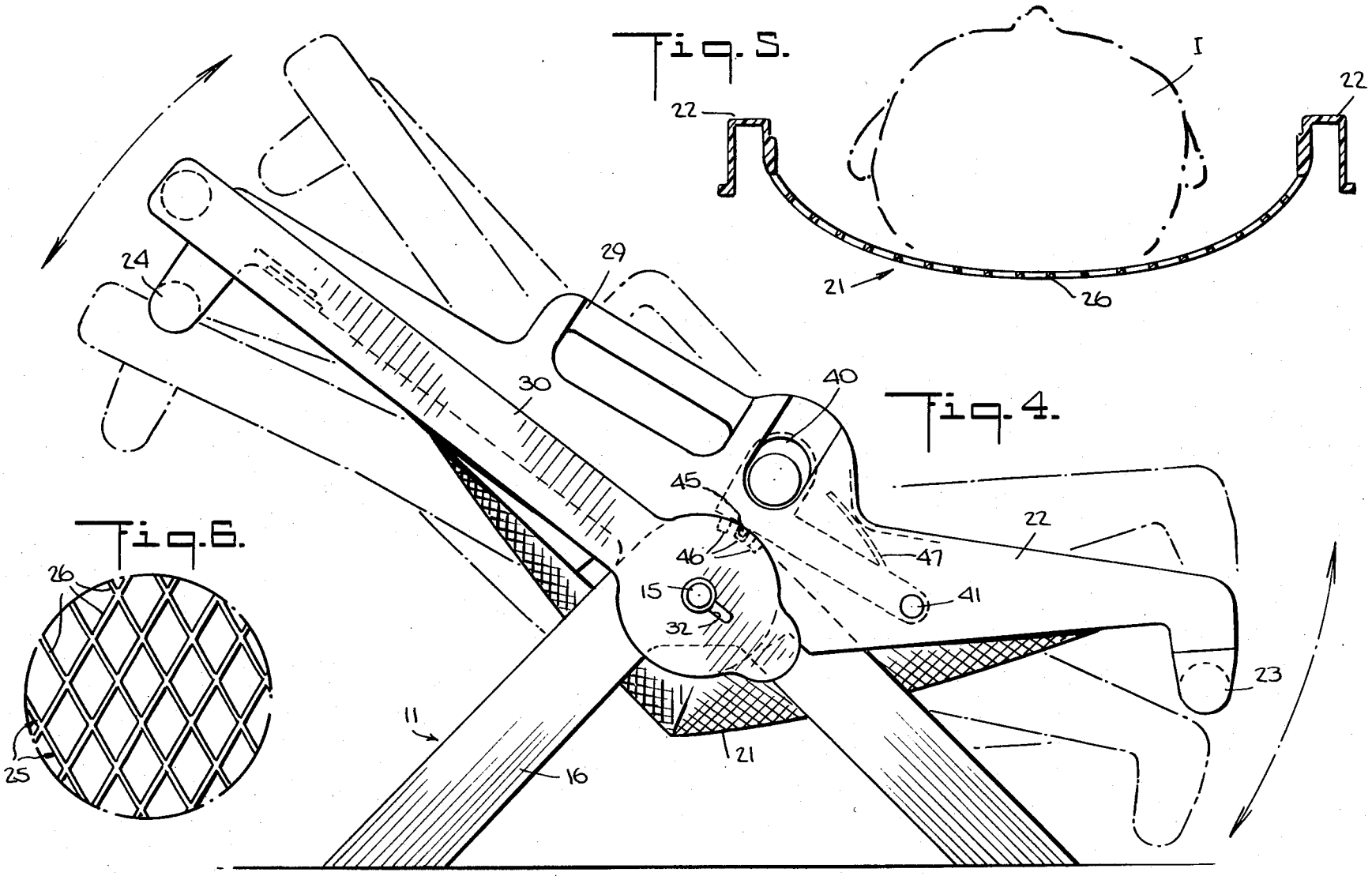
FIG. 4 illustrates a side view of the infant carrier of FIG. 1.
FIG. 5 illustrates a view taken on line 5—5 of FIG. 1.
FIG. 6 illustrates an enlarged detailed view of the mesh body according to the invention.

Referring to FIGS. 4 and 5, the mesh body 21 is integrally formed with the frame 20 and is made of a plastic material such as polypropylene. In addition, the mesh body 21 is itself supporting and has a molded three-dimensional shape defining a recess for receiving an infant I in a cradled manner. In this regard, the mesh provides a contour fit to the infant I, i.e. a contour fit designed to place the infant I in a semi-fetal position.

As indicated in FIG. 6, the mesh body 21 is formed of diamond-shaped meshes 25 which are of uniform size. The meshes 25 are formed by intersecting strands 26 which do not overlap as if woven but rather, as indicated in FIG. 5, the mesh body 21 is on one-piece planar molded construction, i.e. the mesh is flush, so that the thickness is uniform throughout.

The mesh body 21 is integral along the two sides with the walls 22 of the frame 20 and has a transversely extending beading 27, 28 at each end. Each beading 27, 28 is separated from the frame walls 22 at each end by approximately one quarter inch on each side as indicated in FIG. 11. The beading and mesh construction is of importance for several reasons. The separation allows the beading to give or deform between the sides of the rigid frame 20 when weight is applied to the mesh body 21 and thus adapt to the shape of the infant. This would not be possible if the beading ends were attached to the rigid frame 20 and thus held taut between the walls 22 of the frame 20. This separation is of further importance. The mesh principle works not by virtue of the plastic mesh stretching. Although the plastic strands 26 of the mesh can stretch under severe pressure, this is not relied on for the seat mesh to adapt to the shape of the infant. When an infant is placed in the seat, the mesh shapes itself to the infant by means of the diamonds of the mesh being deformed or distorted by the weight of the infant. This can not happen if the mesh is captured at all four borders. Nor could it happen if the beadings 27, 28 at the top and bottom edges ran all the way across the edges and attached to the frame 20.

Referring to FIGS. 4 and 7, the shape of the mesh body 21 is such as to provide a back portion and a front portion which are slightly angled with respect to each other. In addition, the mesh body 21 blends the back and front portions to the wall 22 of the frame 20.

Referring to FIG. 7, the seat 12 is also provided with a pair of oppositely disposed handles 29 which are integrally formed with the walls 22 of the frame 20. As indicated, each handle 29 provides an elongated opening for manual grasping of the seat 12.

Figure 2:
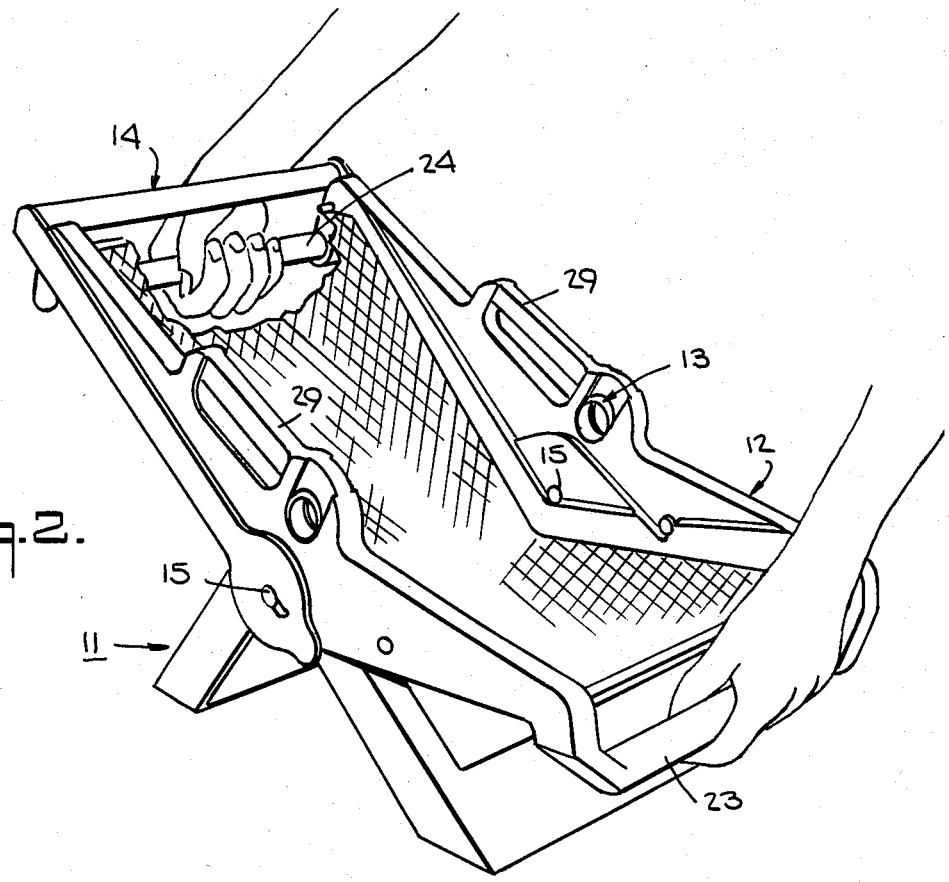
FIG. 2 illustrates a perspective view of the infant carrier of FIG. 1 with the carrying handle in a stored position.

The carrying handle 14 is of generally U-shape and has a pair of flat arms 30 and a cross-bar 31 of hollow tubular shape which integrally connects the arms 30. Each arm 30 is provided with an elongated slot 32 at a lower rounded end to accommodate passage of a rivet 15. As such, the handle 14 is able to pivot on the rivets 15 relative to the seat 12 between a raised position as shown in FIG. 1 and a stored position as shown in FIGS. 2 and 4.

Each arm 30 also has a shoulder 33 on the inside surface about the slot 32 (FIG. 7) and a raised button or protuberance 34 below the shoulder 33. Each shoulder 33 cooperates with a shaped slot 35 which is formed within a raised circular portion 36 on a wall 22 of the seat frame 20 while each protuberance 34 cooperates with a recess 37 in the circular portion 36. As shown, the slot 35 has a narrowed upstanding portion and an enlarged lower portion.

As shown in FIG. 10, when the handle 14 is in the raised position, each shoulder 33 of an arm 30 is received within the narrow portion of the slot 35 while the button 34 is received within the recess 37. The handle 14 is thus locked in the raised position.

Referring to FIG. 9, when in the stored position, each shoulder 33 of an arm 30 is received within the enlarged portion of a slot 35 while the button 34 is displaced away from the recess 37. In this position, the handle 14 is free to rotate counter-clockwise as viewed. Accordingly, each wall 22 of the seat frame 20 is provided with a shoulder 38 at an upper end, as shown in FIG. 7, to cooperate with a similar shoulder 39 on an upper end of each arm 30 so as to provide a stop for the handle 14.

Referring to FIGS. 7 and 8, each lock means 13 includes a P-shaped pawl 40 which is pivotably mounted in a wall 22 of the seat frame 20. As indicated, each pawl 40 carries an integral axle 41 in the form of a pair of projecting cylindrical pads which are rotatably received within a pair of aligned apertures 42 in a channel-shaped wall 22 of the seat frame 20. In addition, each pawl 40 includes a finger receiving aperture 43 at an upper end which is exposed via openings 44 in a raised portion of each wall 22 adjacent to a handle 29. The inner contour of each wall 22 and the size of each pawl 40 is such that the pawl is able to slide within the wall 22 during pivoting about the axle 41 with the finger receiving apertures 43 aligned with the openings 44 in the wall 22.

In addition, each pawl 40 has a detent 45 on an underside for insertion into one of a plurality of spaced slots 46 near the apex of a leg 16 of the leg support 11. A spring in the form of a leaf spring 47 is also provided on the pawl 40 either integrally or separately to bias the pawl 40 towards the leg support 11 so as to position the detent 45 in one of the slots 46. As indicated in FIG. 8, the leaf spring 47 is abutted against an inside surface of the wall 22.

Referring to FIGS. 1 and 7, each rivet 15 passes through the aperture 32 in the handle 14, the slot 35 in a wall 22 and a suitable aperture 48 (see FIG. 7) on the inside of a wall 22 and the apertures 19 in a leg 16 of the leg support 11. Alternatively, other suitable means may be used to interconnect the various components together, for example a nut and bolt assembly may be used.

In order to use the infant carrier, an infant I is placed into the recess formed by the mesh body 21 (see FIG. 1) so as to be received in a cradled position. At this time, the meshes 25 of the mesh body 21 deform to adapt to the shape and contour of the infant I so as to maintain the infant I in a semi-fetal position. Thereafter, the handle 14 can be rotated from the stored position into the raised position. To this end, the handle 14 is first rotated from the stored position into a position vertical to the horizontal of the carrier. At this time, as indicated in FIG. 9, the shoulders 33 on the inside of the arms 30 are pivoted into a vertical position in alignment with the narrow portions of the slots 35. In addition, the buttons 34 are moved into alignment with the recesses 37. Thereafter, the handle is lifted slightly to slide the shoulders 33 into the narrow portions of the slots 35 while also moving the buttons 34 into the recesses 37. In this way, the handle 14 is locked with respect to the seat 12. The carrier 10 may then be lifted via the handle 14 and carried in a pendulum-like manner as indicated in FIG. 1. Of note, during this time, the lock means 13 serve to hold the leg support 11 in a fixed position relative to the seat 12.

Figure 3:
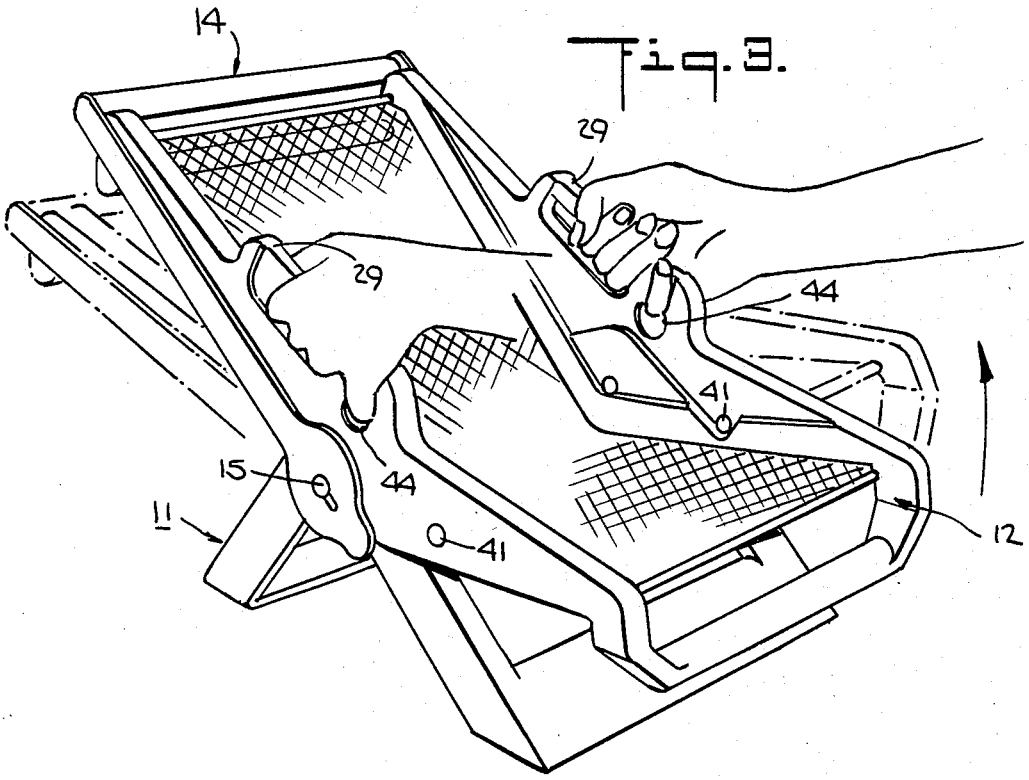
FIG. 3 illustrates a perspective view of the infant carrier of FIG. 1 prior to adjustment into a different reclined position.

In order to change the position of the seat 12 relative to the leg support 11, with or without the infant I in place, the carrier 10 is placed on a support surface and the handle 14 moved into the stored position. In this regard, the handle 14 is first depressed vertically so as to disengage from the recesses 37 and the narrow portions of the slots 35. Thereafter, the handle 14 can be rotated into the stored position against the projections 38 on the seat 12. Next, the handles 29 are grasped, as indicated in FIG. 3, and the pinky finger of each hand passed through the finger-receiving apertures 43 of the pawls 40. The pawls 40 are then lifted by the pinky fingers to pivot about their respective axles 41. This removes the respective detent 45 from the respective slot 46 in the leg support 11 so that the seat 12 is now free to rotate relative to the leg support 11. After being positioned in the desired position, the pawls 40 are released to move under the bias of the respective springs 47 into the newly-selected slots 46. The carrier 10 may then be lifted and carried to another place, if desired.

Referring to FIG. 2, instead of carrying the carrier 10 via the handle 14, the carrier 10 may also be transported via the handles 29 or the cross-bars 23, 24 of the seat frame 12.

The carrier 10 thus provides a means of comfortably positioning an infant, for example a newly-born infant to an infant of about four months of age in a semi-fetal position. The carrier also provides a mesh body which permits air to circulate therethrough to provide for cooling of an infant and thus avoid perspiration.

Because the mesh body 21 and the skeletal frame 20, can be molded in a one step operation, the cost of fabricating the overall carrier and thus the cost to the user can be reduced. Likewise, the use of a minimum number of parts and the interfitting relationships of parts permits fabrication of the carrier to be relatively inexpensive.

The carrier can be made lightweight, for example the total weight may be about two pounds. If required, the carrier may also be provided with a pelvic or center strap for retaining an infant in place.

What is claimed is:

1. A carrier for an infant comprising a contoured skeletal frame; and a mesh body secured to and across said frame for receiving an infant thereon in a cradled manner, said mesh body being secured at each of two opposite sides to said frame and being separated from said frame at each of two opposite edges and at each end of each said edge to permit said mesh body to deform between said sides under the weight of an infant.

2. A carrier as set forth in claim 1 wherein said mesh body and said frame are integrally formed of plastic material.

3. A carrier as set forth in claim 2 wherein said plastic material is polypropylene.

4. A carrier as set forth in claim 1 wherein said mesh is made of a one-piece planar molded construction.

5. A carrier for an infant comprising a contoured skeletal frame; and a mesh body secured to and across said frame for receiving an infant thereon in a cradled manner, said mesh body being secured at each side to said frame and having a transversely extending beading at each end separated from said frame at each end thereof to allow deformation of said mesh body between said walls under the weight of an infant.

6. A carrier as set forth in claim 5 wherein said mesh body and said frame are integrally formed of plastic material.

7. A portable infant carrier comprising a leg support; and a seat adjustably mounted on said leg support, said seat having a contoured frame including a pair of parallel upstanding walls and a mesh body integrally formed with and extending across said frame between said walls, said mesh body being secured at each side to a respective wall and having a transversely extending beading at each end separated from said frame at each end thereof to allow deformation of said mesh body between said walls under the weight of an infant.

8. A portable infant carrier as set forth in claim 7 wherein said mesh body is made of one-piece planar molded construction.

* * * * *

UNITED STATES PATENT AND TRADEMARK OFFICE

CERTIFICATE OF CORRECTION

PATENT NO. : 4,516,806

DATED : May 14, 1985

INVENTOR(S) : Quentin McDonald

It is certified that error appears in the above-identified patent and that said Letters Patent is hereby corrected as shown below:

Column 2, line 42 change "position; and" to - position; -

Column 2, line 44 change "position." to -position; and-

Signed and Sealed this

*Tenth* Day of *June 1986*

[SEAL]

*Attest:*

DONALD J. QUIGG

*Attesting Officer*

*Commissioner of Patents and Trademarks*